US005706545A

United States Patent [19]

Yamada

[11] Patent Number: 5,706,545

[45] Date of Patent: Jan. 13, 1998

[54] MULTI-POSITIONABLE TOOTHBRUSH

[76] Inventor: Todd H. Yamada, 13900 Tahiti Way, #127, Marina Del Ray, Calif. 90292

[21] Appl. No.: 725,734

[22] Filed: Oct. 4, 1996

[51] Int. Cl.[6] ..... A46B 9/04

[52] U.S. Cl. ..... 15/172; 2/144.1; 2/167.1

[58] Field of Search ..... 15/144.1, 167.1, 15/172, 145, 176.1, 160, 185, 201

[56] References Cited

U.S. PATENT DOCUMENTS

| | | | |
|---|---|---|---|
| 4,875,248 | 10/1989 | Kent | 15/143.1 |
| 5,315,732 | 5/1994 | Hueffner et al. | 15/172 |
| 5,324,129 | 6/1994 | Root | 15/172 X |
| 5,327,608 | 7/1994 | Kosakewich | 15/172 |
| 5,442,831 | 8/1995 | Yamada | 15/144.1 |
| 5,530,981 | 7/1996 | Chen | 15/144.1 |
| 5,572,763 | 11/1996 | Eguchi | 15/172 |
| 5,581,838 | 12/1996 | Rocco | 15/172 |

FOREIGN PATENT DOCUMENTS

| | | | |
|---|---|---|---|
| 0454625 | 10/1991 | European Pat. Off. | 15/143.1 |

*Primary Examiner*—Jeanette E. Chapman
*Attorney, Agent, or Firm*—Beehler & Pavitt

[57] ABSTRACT

A multi-positionable toothbrush comprising a brush array member shiftably supported on the forward end of a hollow handle member within which is housed a toothed element adapted to change its position in accordance with the tooth setting in reference to a spring biassed lever having a detent adapted to be disposed between the teeth in the toothed element; the particular disposition being effected by pressing the lever against its spring bias to allow the brush array member to have its position changed relative to the axis of the handle member.

5 Claims, 2 Drawing Sheets

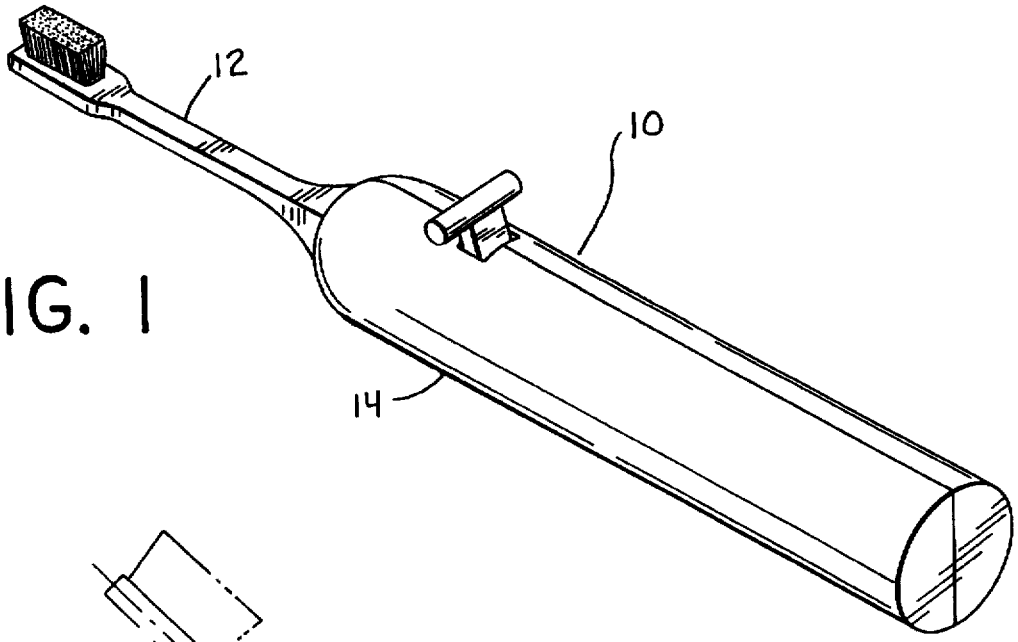
FIG. 1
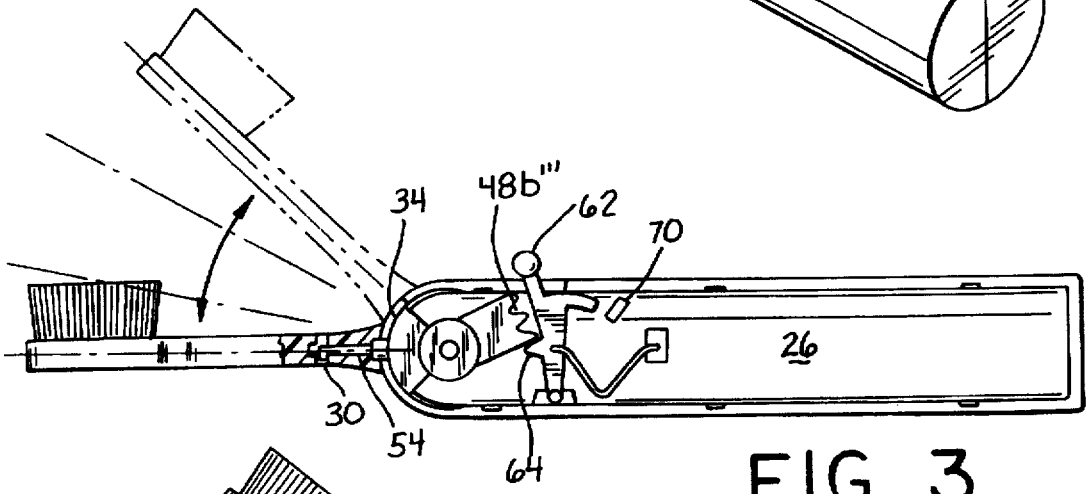
FIG. 3
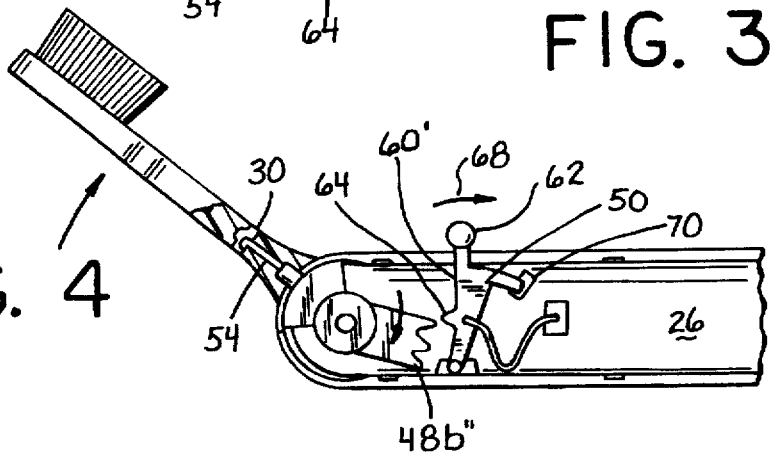
FIG. 4
FIG. 5
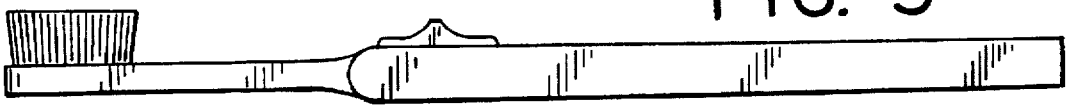

MULTI-POSITIONABLE TOOTHBRUSH

FIELD OF THE INVENTION

This invention relates to the field of multi-positionable brushes in general, and, in particular, to multi-positionable toothbrushes.

BACKGROUND OF THE INVENTION

DESCRIPTION OF THE PRIOR ART

The desirability for certain uses of a toothbrush, the bristle array of which can be moved angularly with respect to the handle has been recognized for more than a 100 years, as evidenced by U.S. Pat. No. 430,909. Since then, there have been issued numerous United States and foreign patents on toothbrushes designed with such capability. Examples are British Patent No. 191,745, issued in 1923; Austrian Patent No. 134,759, issued in 1933; French Patent No. 1,075,819, issued in 1954; German Patent No. 214,298, issued in 1960; French Patent No. 2,450,579, issued in 1979; and U.S. Pat. Nos. 4,731,896, 5,033,154, 5,003,658, 5,228,166 and No. 5,442,831, issued Aug. 22, 1995, to one of the present co-inventors.

The problem with the prior art devices is that they have not met all of the desired features for an angularly adjustable toothbrush. Principal among these features are: effectiveness in holding each angular position in which the toothbrush may be set; simplicity of construction and assembly and related requirement of minimizing the expense of its manufacture; convenience for the user, both from the standpoint of adjusting the angle and from the standpoint of holding the brush during the toothbrushing operation. It is also desirable to have the brush offer the user at least four or five different angular positions. Prior art brushes have failed adequately to meet one or more of these desirable features.

SUMMARY OF THE INVENTION

The present invention may be constructed of five moldable parts and a small spring member.

These five parts are the brush array holder, two semi-cylindrical or other elongated space defining halves, a brush array support element and an angle selector member. The brush array member is elongated and rigid, with its forward end carrying bristles extending transversely outwardly from one side of the forward end. The after end of the brush array member contains an axial bore which extends part-way into the member and terminates in a short transverse passage. The handle itself may be formed by bringing together the two semi-cylindrical or other elongated space defining halves, each being closed by a transverse closure at its after end and capped at its forward end by a semi-dome having an arcuate outer edge with a recess to define one half of a first slot. The upper side edge of each said half is recessed similarly to form a second slot when the two halves are brought together.

The inner walls of the two cylindrical halves, when brought together, will define a cavity in which are provided a forward pair of journals adjacent the dome and centrally disposed with respect thereto. A second pair of journals may be provided rearwardly of the first journals and adjacent the bottom edges of the walls of the two halves. In addition, one of the halves may be molded to provide a projecting anchor for a spring hereinafter described. Provision is made for the two halves to be snapped together to form an integral handle member.

For disposition within the cylindrical or other defined cavity defined by the walls of the halves when brought together, is a partially rotatable brush array support element comprising a forward arcuate block having substantially the same radius of curvature as that of the inside of the dome formed by bringing together the two semi-domes. Extending rearwardly from the arcuate block and, preferably, unitary therewith is a rectangular block which terminates in a plurality of transverse ridges and valleys. Trunnions are provided on each side of the arcuate block to be inserted for rotational movement within the first journals. A rigid stem extends radially forward of the arcuate block for insertion into the bore in the after end of the brush array member, the stem having a hook or transverse portion at its end for snap locking in the transverse orifice at the inner end of the bore. This stem extends through the first slot formed by the recesses in the semi domes of the two elongated halves when brought together. Preferably, the after end of the bristle array member is flared outwardly, not only to cover the slot but also to provide some support for the brush array member against the outside of the dome wall. The brush array member thus may be swung angularly with respect to the axis of the handle section—to the extent of the angle circumscribed by the first slot through which the projecting stem may be moved.

Selection of the particular angle is determined by the setting of the angle selector element, the base of which is provided with laterally extending trunnions which are supported in the second journals within the handle cavity. This element extends upwardly into the cavity and is capped by a lever which is disposed to protrude up through the second slot. A projection extends forwardly from the front face of the angle selector element.

A spring extends between the inner wall anchor and the angle selector element to bias the latter forwardly to urge its forward projection into one of the valleys in the terminus of the rectangular block of the brush array support element.

It may be seen from the description of the novel toothbrush of the present invention that it is a very simple matter to adjust the angle of the brush array member with respect to the axis of the handle member. One simply pulls back the lever which protrudes through the second slot defined by the recesses in the upper edges of the elongated space defining halves which, when brought together and secured, form the handle member. This results in the disengagement of the projection which extends forwardly from the angle selector element into one of the valleys at the terminus of the rectangular block of the partially rotatable brush array support element. Thereby, one may manually adjust the angle of the brush array member with respect to the axis of the handle member. When the desired angle is attained, release of the lever will result in the forward projection of the angle selector element engaging a valley at the after end of the rectangular block of the brush array support element, thereby to secure the brush array member and the handle member in the set angle until the lever protruding from the handle member is again moved back against the bias of the spring. The outer end of the lever may be formed as a flattened element which slides against the outside of the elongated half through which the lever projects.

It may thus be seen that the present invention provides an easily adjustable angled toothbrush of a simple design which may be fabricated of five molded parts and a spring, all of which are easily assembled. While the two elongated space defining halves comprising the handle could be simply secured other than by adhesive, it would also be possible to secure those halves together by snap locks which are well known in the plastic art.

DESCRIPTION OF THE DRAWINGS

In the accompanying drawings:

FIG. 1 is a perspective view of an embodiment of the toothbrush of the present invention in its axially extended position;

FIG. 3 is a side elevation partly in section of the toothbrush shown in FIG. 1;

FIG. 4 is a partial view similar to FIG. 3 showing the brush array member elevated to its maximum angle in relation to the axis of the handle member; and FIG. 5 is a perspective view similar to that of FIG. 1 of a toothbrush of the present invention in which handle has been streamlined.

DESCRIPTION OF THE PREFERRED EMBODIMENT

Figure 2:
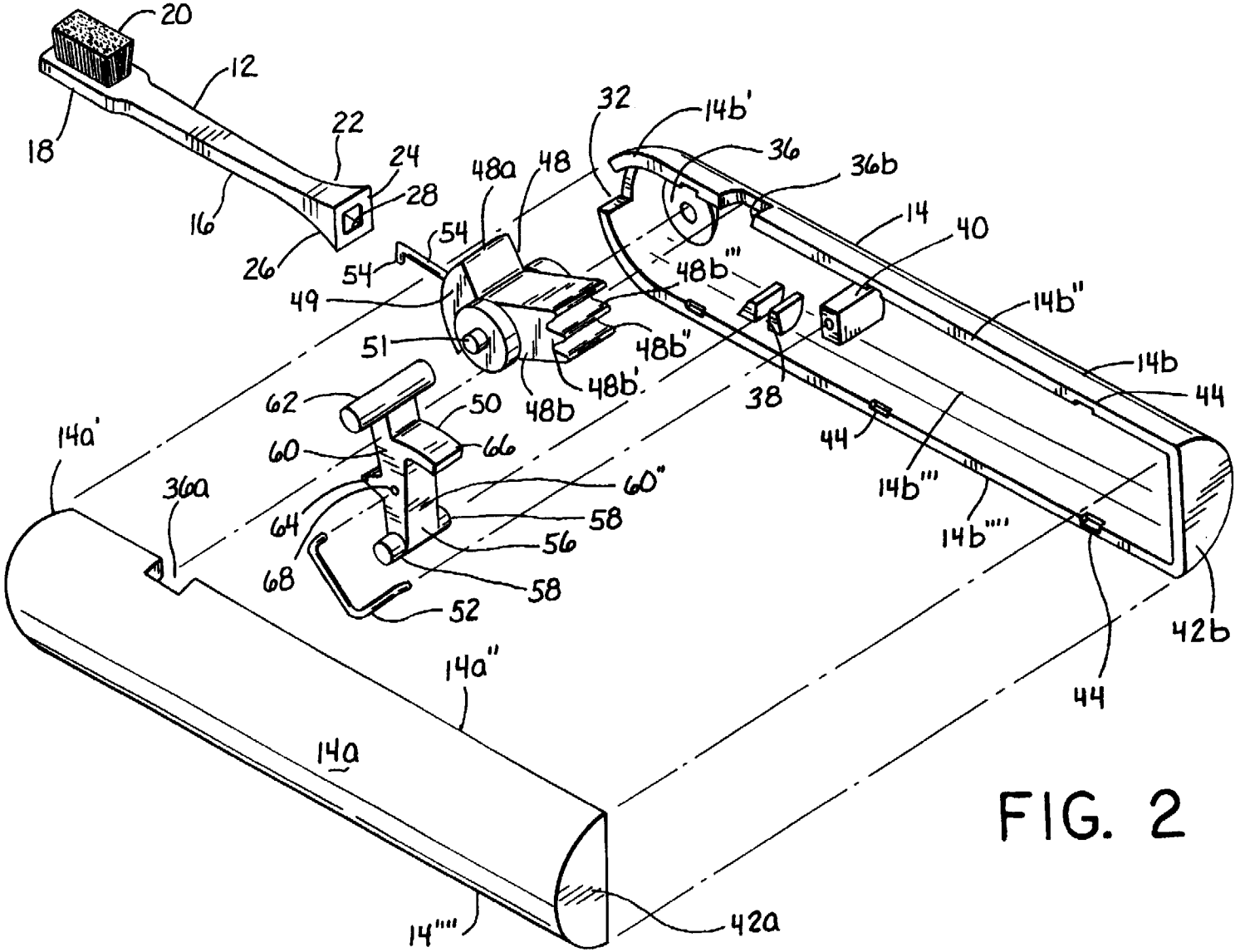
FIG. 2 is an exploded perspective view of the toothbrush shown in FIG. 1.

FIGS. 1–4 of the application illustrate an embodiment of the invention with an enlarged cylindrical handle in order to more clearly disclose the mechanical aspects of the invention. Desirably, however, a toothbrush with the features herein described would be provided with a thinner handle, and one not cylindrical in configuration, so as to appear more as shown in FIG. 5.

Referring to FIGS. 1 and 2, a toothbrush 10 is constructed of brush array member 12 and a handle member 14. The brush array member 12 may be molded of plastic as an elongated element 16 having a forward end 18 supporting a brush or brush array 20. The after end 22 of the brush array member terminates in a surface 24 which is arcuate and flared out as shown at 26 in FIG. 2. The arcuate surface 24 has an axial bore 28 which terminates in a transverse passage 30 (FIGS. 3 and 4).

The handle member 14 may be formed of two semi-cylindrical or other elongated space defining halves **14*a* and 14*b*. Each of these halves 14*a*, 14*b* is capped by an arcuate semi-dome 14*a*' and 14*b*', respectively. Each of said semi-domes may be recessed at 32 (not shown at 14*a*') so that, when the two semi-domes 14*a*' and 14*b*' are brought together, a first arcuate slot 34 is defined. In addition, each of the two elongated halves 14*a* and 14*b* may be recessed at 36*a*, 36*b*, respectively along its upper edges 14*a*", 14*b*". The inside wall 14*b*''' of the half 14*b* is preferably molded to provide a first journal 36, a second journal 38, and a spring anchor member 40. The inside wall (not shown) of the half 14*a* would be similarly molded with journals, (also not shown) corresponding to, and aligned with, journals 36 and 38. The after end of each half 14*a*, 14*b* is preferably closed by a transverse bottom wall 42*a* and 42*b*, respectively. Desirably, also a plurality of snap lock recesses 44 are provided along the upper edges 14*b*" of the half 14*b* and the lower edges 14*b*"" of the half 14*b*. Not shown, but provided correspondingly along the edges 14*a*" and 14*b*"" are a series of projections located and designed to snap into the recesses 44 in the half 14*b***, thereby to enable the two halves to be brought together and snap-locked in a manner well known in the manufacture and assembly of plastic parts.

Before the two halves **14*a* and 14*b* are brought together, a brush array support element 48, and an angle selector element 50, together with a spring 52 are disposed within the cavity 26 defined by the inside walls of the elongated halves 14*a* and 14*b***.

The brush array support element 48 is formed of a forward arcuate block section **48*a* from the rear side of which extends a rectangular block section 48*b*, the after end 48*b*' of which terminates in an a series of transverse ridges 48*b*" and valleys 48*b*'''. Desirably, the element 48 is unitary. Extending from each side 49 of the element 48 is a trunnion 51 adapted rotatably to seat in the first journal 36. A stem 54 (FIGS. 3 and 4) protrudes from the forward arcuate block 48*a* of the element 48. This stem 54 terminates in a hook or transverse member 54'. This stem is designed to fit in the bore 28 in the brush array member 12, with its hook 54' engaging the transverse passageway 30 at the inner end of the bore 28**.

The angle selector element 50 includes a lower end 56 from which extends from each side a trunnion 58 to be mounted for rotation in the second journals 38. The element 56 has an upwardly extending section 60 adapted to extend through the slot formed by the recesses **36*a* and 36*b* and capped by a cylindrical head 62. Extending forward of the front face 60' of the section 60 is an angular projection 64, and from its back side 60", an arcuate projection 66**.

The toothbrush of the present invention is assembled by first disposing the brush array support element 48 within the semi-dome **14*b*' of the handle half 14*b*, and inserting a trunnion 51 in the journal 36**.

One end of spring 52 is inserted in the spring anchor member 40, and the other end, in the orifice 68 in the side of the element 50. At this time, the projection 64 will be inserted in the one of valleys **48*a*", 48*b*''' at the rear of the rectangular block section 48*b* of the brush array support element 48. The other half cylinder 14*a* is then brought edgewise against the cylinder half 14*b*, with the trunnions 51 and 58 being seated in corresponding journals 36 and 38 (not shown in 14*a*). The two halves may then be snapped together by inserting projections (not shown in 14*a* in the recesses 44 in the upper and lower edges 14*b*" and 14*b*"" of the cylinder half 14*b*. Stem 54 is then inserted in the axial bore 28 to the point where its hook or transverse element snaps into the transverse passage 30 at the end of the bore 28 in the elongated brush array member 12**.

Adjustment of the angular selection of the brush array member 12 with respect to the handle member 14 may be accomplished by pulling back on the cylindrical cap 62 in the direction of the arrow 68 (FIG. 4), thereby moving the element 50 rearwardly to disengage the projection 64 from any of the valleys **48*b*''' and to clear the ridges 48*b*". When such clearance is effected, the brush array support element 48 to which the brush array member 12 is attached by the stem 54 may be swung upward in an arc limited by the first slot 34 formed by the recesses 32 in the semi-domes 14*a* and 14*b* of the semi-cylindrical halves 14*a* and 14*b* which form the handle member. The movement of the angle selection element 50 may be limited by a stop member 70 which may be provided on one or both of the inside walls 14*a*' (not shown) and 14*b*' of the semi-cylindrical members 14*a* and 14*b***.

When the element 50 is disposed in its rearmost position, as shown in FIG. 4, so that the projection 64 clears the ridges **48*b*' of the member 48, the brush array member 12 may be set to any of the angular positions shown in FIG. 3 and locked in such position by the release of the element 50, thereupon to be pressed forward by the spring 52 to seat the projection 64 in one of the valleys 48*b*''', or on one side or another of the terminus of the rectangular block 48*b***.

As previously mentioned, the preferred configuration of the handle members is shown in FIG. 5 where it may be seen that the two halves may be rectangular with rounded outer edges so that the embodiment appears to look and feel like a customary toothbrush and the lever cap appears as a sloping slideable element. However, when the halves are referred to in the claims as being semi-cylindrical, that term should be deemed to comprehend any other shape of an elongated space-defining half member which would be similarly constructed internally and would perform the same functions as those disclosed in FIGS. 1–4 and described hereinabove.

It may be seen from the foregoing description, that an adjustable angle toothbrush may be provided by the present invention which may be manufactured and assembled easily by the use of molded parts, and when assembled, may be simply operated to allow a predetermined range of angular adjustments with respect to the axis of the handle member.

I claim:

1. An angularly adjustable toothbrush comprising:

an elongated brush array member, said member having a predetermined length, with a forward end and an after end, the forward end supporting brush array extending laterally, and the after end of said member being concavely arcuate and having an axial bore terminating inwardly in a transverse passageway;

a handle member, said handle member being formed of two semi-cylindrical mating halves secured together edgewise, each half having an inner wall and a semi domed forward end and a closed after end, the inner walls of said two halves, when brought together, defining a hollow forward section of said handle member capped by a dome with a predetermined radius of curvature, the forward domed end of which handle member is recessed to form an arcuate first slot; the inner wall of one of said halves having projecting means to receive and secure one end of the spring, each of said handle member halves further having transversely extending from their respective inside walls and co-axially with each other a first journal adjacent to an end and centrally disposed within the domed forward end; and, spaced rearwardly from the first journal adjacent the bottom edges of the halves, each half is provided with a second journal co-axial with the corresponding second journal in the other handle half; and the upper edges of each half being recessed to provide a second slot when the halves are brought together and secured to each other;

said handle member further enclosing a partially rotatable brush array support element, the last said element being formed of a forward arcuate block section having a radius of curvature corresponding to that of the dome, and, unitary therewith, a rearwardly extending rectangular block section terminating in a plurality of transverse ridges and valleys, said forward arcuate block section having laterally extending from its sides, a pair of trunnions each disposed to rotate within a first journal; the forward arcuate block section further having a rigid stem projecting radially forwardly with respect to the arc of curvature of said arcuate block section, the forward end of said stem terminating in a transverse tip; said stem being inserted into the bore of the brush array member with its tip engaging the transverse passageway in the bore;

said handle member further enclosing a pivotable rigid angle selection element, the last said element being elongated and having a bottom end and an upper end, the bottom end being provided with trunnions disposed in the second journals in the inner walls of the halves, and the upper end of the angle selecting element terminating in a lever projecting through the second slot, the angle selecting element having a forward side parallel to the axis of its trunnions and an opposite after side, the forward side having a projection receivable in each of the valleys at the terminus of the rectangular block section of the partially rotatable brush array support element, and the after side having a rearwardly extending shoulder which is adapted to move between a first position in abutment with the edges of the inside walls of the handle member halves, and a second position spaced from said upper inside walls; and said spring having a first end anchored in the transverse projecting means in the one of the halves of the handle member and extending to the angle selector element to bias the last said element forwardly toward the ridges and valleys of the terminus of the rectangular block of the partially rotatable brush array support element, and thereby the projection on the forward side of the angle selector element into a selected valley in the terminus of the rectangular block section of the partially rotatable brush array support element; the lever protruding upwardly through a second slot serving to enable the angle selector element to be moved rearwardly to disengage the projection on the forward side of the angle selector element from any valley into which it may be biased, thereby to permit the bristle array member to be shifted angularly with respect to the handle member to a selected angular position permitted by the partially rotatable brush array support element, in which position the brush array member and the handle member may be temporarily secured upon release of the lever and the action of the spring against the angle selector element.

2. The angularly adjustable toothbrush as described in claim 1 wherein the rectangular block section of the partially rotatable element is adapted to move between a first position in which the upper edge of the block section is in abutment with the upper inside edges of the inner wall halves, and a second position in which the lower edge of the terminus of said rectangular block section is in abutment with the lower edge of the inner wall halves, and projection on the forward side of the angle selector element is adapted to be moved through the upper and lower edges of the terminus of the rectangular block section of the partially rotatable brush array support element, thereby to augment the angle through which the brush array member may be shifted in relation to the axis of the handle member.

3. The toothbrush as described in claim 2 wherein a stop member is provided on the inside wall of at least one of the halves of the handle members to a rearward movement of the angle selecting element.

4. The toothbrush as described in claim 1 wherein the after end of the brush array member is flared outwardly and arcuately to conform with radius of curvature of the outside wall of the dome formed by the joinder of the forward ends of the mating halves.

5. The toothbrush as described in claim 1 wherein the end of the lever projecting through the second slot is capped with an element having a raised center portion and downwardly sloping walls, the edges of which are in abutment with the outer wall of the handle member half defining the second slot to slide over said outer wall when the lever is moved in the second slot.

* * * * *